US006230500B1

(12) United States Patent
Mao et al.

(10) Patent No.: US 6,230,500 B1
(45) Date of Patent: May 15, 2001

(54) CRYOGENIC FREEZER

(75) Inventors: Zhenning Mao, Savage, MN (US); Rolf Wieland, Gilbertsville, PA (US); Steve Shaw, Burnsville, MN (US)

(73) Assignee: MVE, Inc., New Prague, MN (US)

( * ) Notice: Subject to any disclaimer, the term of this patent is extended or adjusted under 35 U.S.C. 154(b) by 0 days.

(21) Appl. No.: 09/408,410

(22) Filed: Sep. 29, 1999

(51) Int. Cl.[7] ..... F17C 3/365
(52) U.S. Cl. ..... 62/45.1
(58) Field of Search ..... 62/45.1, 371; 220/901, 220/592.2, 592.24, 592.25, 592.26, 592.27

(56) References Cited

U.S. PATENT DOCUMENTS

| | | | | |
|---|---|---|---|---|
| 3,515,303 | * | 6/1970 | Robertson et al. | 220/9 |
| 3,862,700 | * | 1/1975 | Noma et al. | 220/15 |
| 4,055,268 | | 10/1977 | Barthel . | |
| 4,154,363 | | 5/1979 | Barthel . | |
| 4,394,929 | | 7/1983 | Patel et al. . | |
| 4,411,138 | | 10/1983 | Leithauser et al. . | |
| 4,472,946 | | 9/1984 | Zwick . | |
| 4,481,779 | | 11/1984 | Barthel . | |
| 4,860,545 | | 8/1989 | Zwick et al. . | |
| 5,005,362 | | 4/1991 | Weltmer, Jr. et al. . | |
| 5,386,706 | | 2/1995 | Bergsten et al. . | |
| 5,404,918 | | 4/1995 | Gustafson . | |
| 5,542,255 | | 8/1996 | Preston et al. . | |
| 5,678,724 | | 10/1997 | Boffito et al. . | |

* cited by examiner

*Primary Examiner*—Corrine McDermott
*Assistant Examiner*—Malik N. Drake
(74) *Attorney, Agent, or Firm*—Piper Marbury Rudnick & Wolfe

(57) ABSTRACT

A rectangular double walled cryogenic freezer has a vacuum space filled with layers of a reflective material. The support material is an open-celled three dimensional geometric grid that provides structural support for the freezer walls to prevent wall deformation when a vacuum is drawn.

8 Claims, 2 Drawing Sheets

CRYOGENIC FREEZER

BACKGROUND OF THE INVENTION

This invention relates to cryogenic freezers, and, more particularly, to a vacuum insulated cryogenic freezer that provides increased storage capacity.

Cryogenic freezers have a wide variety of industrial applications, including but not limited to, storing biological materials such as blood, bone marrow, and micro-organic cultures. These biological materials must be maintained at low temperatures in order to be stored for an extended period without deteriorating.

Cryogenic freezers are double walled, vacuum insulated containers partially filled with a cryogenic liquid such as liquid nitrogen for establishing an extremely cold storage environment. Liquid nitrogen has a low boiling point, 77.4 K (−320.4° F). Since cryogenic liquids have a low boiling point and, thus, a low heat of vaporization, heat inflow from the ambient can cause significant losses of cryogen due to the evaporation.

In order to minimize the amount of cryogen lost due to evaporation, the cryogenic freezer requires thermal and radiant barriers such as insulation and a high vacuum between the container walls. The vacuum space can also be filled with multiple layers of insulation to reduce heat transfer.

An example of multi-layered insulation is a low conductive sheet material comprised of fibers for reducing heat transfer by conduction. Also, the insulation can comprise radiation layers that are combined with the fiber layers. The radiation layer reduces the transmission of radiant heat in the freezer see for example U.S. Pat. No. 5,542,255 to Preston et al. and U.S. Pat. No. 5,404,918 to Gustafson.

The insulation and vacuum chamber of prior cryogenic freezers addresses the heat transfer problems due to the low boiling point of the cryogen. But, the characteristics of the insulation materials pose limitations to the physical design of the cryogenic freezers.

Containers have been designed with the vacuum space capable of maintaining a low pressure of 0.1 microns when the container is holding a cryogen. The shape of these containers has been restricted to a round, oval, or cylindrical structure. These structure provide the strength required by the walls of the container when such a high vacuum is drawn. If the cryogenic freezer were rectangular, the walls would collapse or deform when the vacuum is drawn due to insufficient structural support. Typically, the insulation materials disposed in the vacuum space of flat panel freezers fail to provide enough structural support for the container walls. Thus, the shape of the container is limited to cylindrical shapes.

Accordingly, it is desirable to provide a cryogenic freezer with optimum storage capacity such as a cube or rectangular enclosure which enables the walls of the freezer to maintain their shape when a high vacuum is drawn.

It is an object of the present invention to provide a cryogenic freezer that offers maximum storage capability at a low cost with flat interior and exterior walls.

It is another object of this invention to provide a cryogenic freezer with minimal thermal conductivity.

It is another object of the invention to provide a cryogenic freezer with reduced radiant energy transfer.

SUMMARY OF THE INVENTION

The present invention is directed to a cryogenic freezer for storing materials such as biological products. The cryogenic freezer is rectangularly shaped to provide the freezer with additional storage capacity. The cryogenic freezer includes an inner container with four walls and a bottom surface. The inner container is surrounded by an outer container also with four walls and a bottom surface. The inner and outer containers are secured together at the top edge such that there is a vacuum space defined therebetween. Alternate layers of a reflective insulating material and a support material comprised of a three dimensional geometric grid (geodesic structure) are placed in the vacuum space. The cryogenic freezer also includes a top which covers the inside of the freezer. A vacuum is drawn in the vacuum space creating the thermally insulated cryogenic freezer. The support grid prevents deflection or collapse of the walls due to the pressure differential.

DESCRIPTION OF THE PREFERRED EMBODIMENTS

Figure 1:
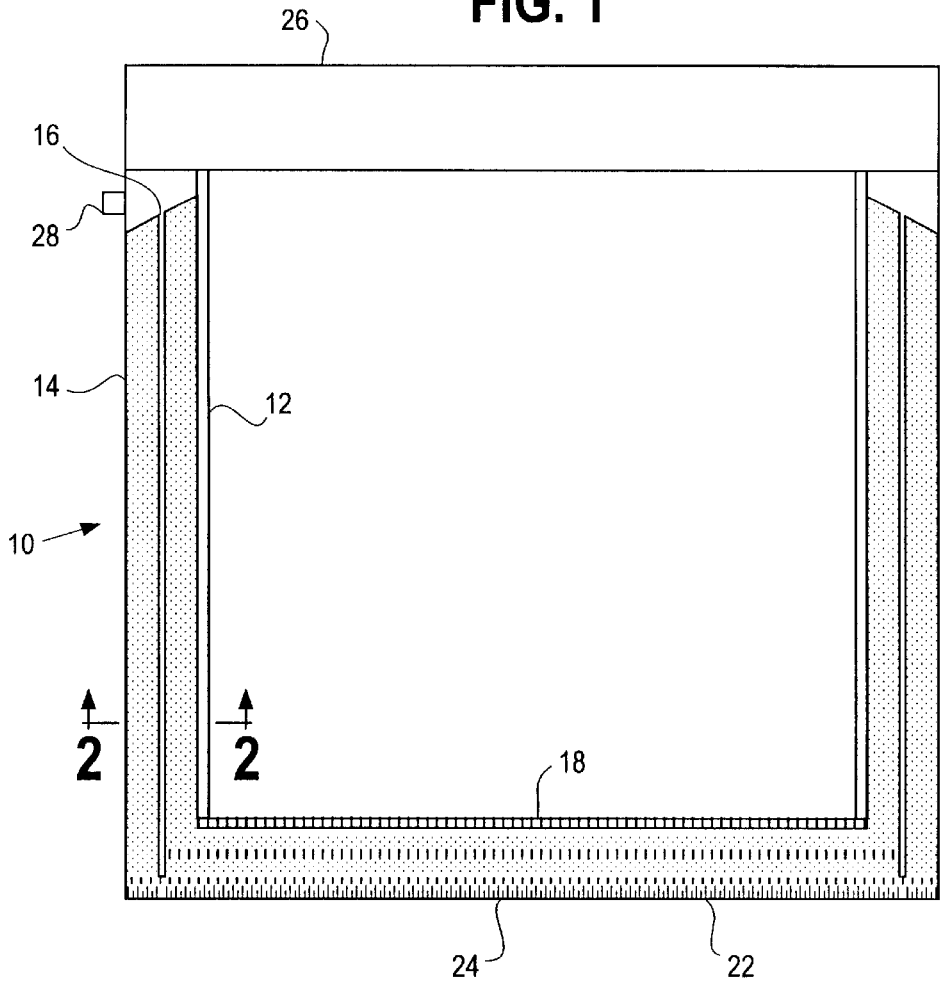
FIG. 1. is a side elevation view showing a section of the cryogenic freezer of the present invention.

With reference to FIG. 1, the cryogenic freezer constructed in accordance with the present invention is indicated generally at 10. The cryogenic freezer 10 features an inner container 12, an outer container 14, and a vacuum space 16 therebetween. The inner container 12 and outer container 14 are preferably constructed from stainless steel. The vacuum space 16 varies depending on the size of the freezer. Typical freezer dimensions are 27"×27"×35"(L×W×H).

The inner container 12 and the outer container l4 each have four side walls and a bottom surface. A top 26 is pivotally connected to the top edge of the inner and outer containers 12, 14. The rectangular freezer takes up the same amount of floor space as cylindrical shaped cryogenic freezers commonly known in the art. But, the larger volume of the rectangular design provides additional storage space in the freezer.

Figure 2:
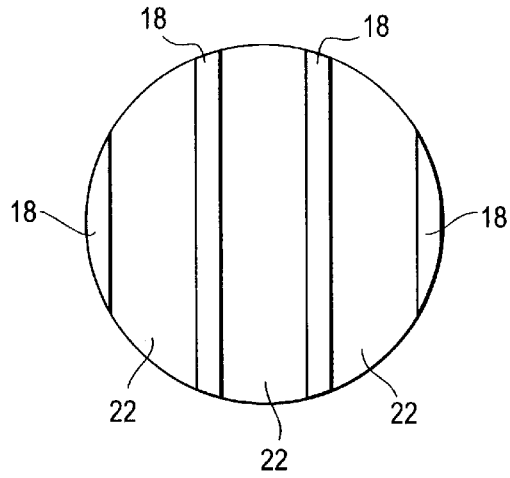
FIG. 2 is a sectional view of the support material and the reflective material that are inserted between the inner and outer container of the cryogenic freezer as seen in FIG. 1.

As seen in FIG. 2, the vacuum space 16 is filled with alternate layers of a reflective material 18 and a support material 22.

The vacuum space includes a molecular sieve 24. The molecular sieve 24, can be, but is not limited to, a carbon or ceramic based material. The molecular sieve 24 is laid on the inside bottom surface of the outer container 14 during assembly. The molecular sieve 24 addresses the problem of out-gassing and chemically absorbs gas remaining after a vacuum is drawn.

Alternatively, getters, commonly known in the art, can be placed at the bottom of the freezer in the vacuum space. The getters also address the problem of out-gassing. The getters chemically absorb the gas remaining after a vacuum is drawn.

The reflective material 18 is comprised of pieces of reflective foil surrounding an insulating material, such as Supergel™ foam manufactured by Cabot Corporation. At least one piece of reflective foil is placed on either side of the insulating material. The air between the reflective foil and the insulating material is evacuated as the pieces of the reflective foil are sealed together. The reflective foil reduces the radiant energy that is transmitted through the vacuum space 16 between the inner container 12 and the outer container 14. The insulating material 20 provides a thermal barrier between each layer of reflective foil.

Figure 3:
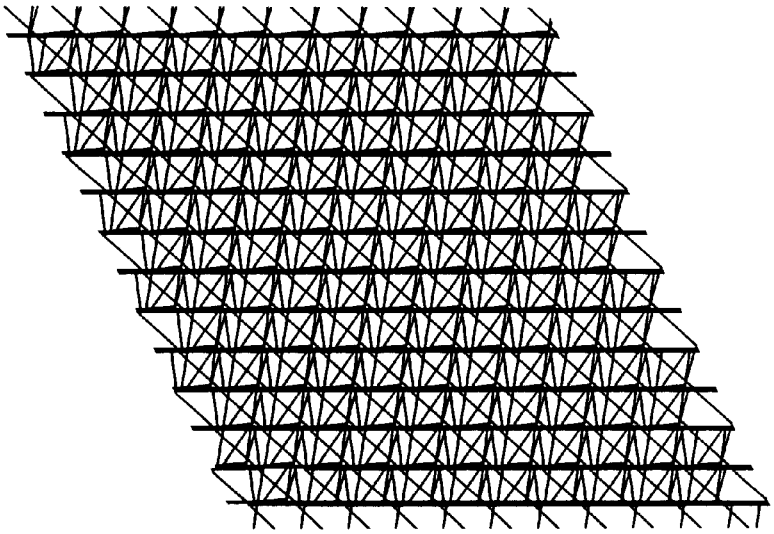
FIG. 3 is a perspective view of the support material that is inserted between the inner and outer container of the cryogenic freezer as seen in FIG. 1.

FIG. 3 illustrates a perspective view of the three dimensional (geodesic) support material 22. The support material 22 may be, but is not limited to, a composite, plastic, or a ceramic grid structure. The support 22 should be selected to limit the thermal conductivity and control out-gassing in the vacuum space. For example, the support material may be, but is not limited to, polyurethane, Ryton R4, Vectra LCP, Vectra E130, Noryl GFN-3-801, Ultem 2300, Valox 420, profax PP701N, Polypropylene Amoco, and Nylon 66.

The support material 22 provides physical support to the walls 12 and 14 so that when a vacuum is drawn, they do not collapse. The support material 22 can withstand the maximum pressure at full vacuum because of its lattice structure. The support material 22 uniformly distributes the load on the inner and outer walls 12, 14. Thus, the thickness of the inner and outer container 12, 14 can be reduced. The yield strength of the support panel is greater than 15 psi. One source of such material is Molecular Geodesics, Inc. of Boston, Mass.

Figure 4:
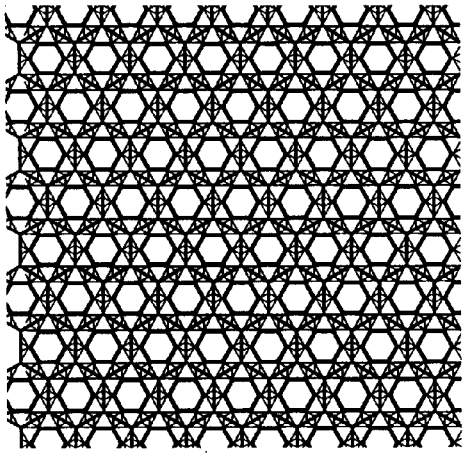
FIG. 4 is a top view of the support material.

FIG. 4 illustrates a top view of the support material 22. The support material 22 is configured with an open-cell structure with a minimal thermal transmission path to allow air to be evacuated out of the vacuum space 16 to form the vacuum. The open cell grid structure enables the molecular sieve 24 to absorb residual moisture and gas in the vacuum space to insure long vacuum life.

The low heat transfer coefficient ($K \leqq 0.001^{w/}{}_{mk}$) of the support material 22 will minimize the heat conducted from the outer wall 14 to the inner wall 12. The support material 22 also reduces heat conductivity by maximizing the open space and minimizing direct contact between the support material 22 and the walls 12, 14.

The cryogenic freezer 10 is assembled by placing the molecular sieve 24 on the inside bottom surface of the outer container 14. Alternate layers of the reflective material 18 (and insulation) and the support material 22 are layered in the vacuum space such that the first and last layer placed are reflective material 18. The inner container 12 is inserted into the outer container 14 so the final layer of reflective material 18 abuts against the outside of wall 12. After the inner container 12 is positioned, the inner container 12 and the outer container 14 are welded together at their tips to seal the space 16 therebetween.

A vacuum is drawn in space 16 to increase the insulation value of the freezer. The cryogenic freezer 10 includes a port 28 in the wall 14 for that purpose. The port 28-may be located at the rim of the top or on the bottom of the freezer. A vacuum pump, well known in the art, is connected to the port 28 to evacuate the air in the vacuum space 16. Thereafter the port is sealed.

While the preferred embodiments of the invention have been shown and described, it will be apparent to those skilled in the art that changes and modifications may be made therein without departing from the spirit of the invention, the scope of which is defined by the appended claims.

What is claimed is:

1. A cryogenic freezer for storing materials at temperatures deviating greatly from ambient comprising:

a) an inner container, said inner container comprising four walls and a bottom surface;

b) an outer container enclosing the inner container and defining a vacuum space therebetween, said outer container comprising four walls and a bottom surface, said inner container being connected to the outer container at the top of said walls to seal said vacuum space;

c) at least one layer of insulating material in said vacuum space for reducing heat transfer in the freezer;

d) at least one layer of support material positioned in the sealed vacuum space for substantially reducing deflection of the walls, when air is evacuated from the vacuum space, and e) a top for covering the inside of the cryogenic freezer.

2. The cryogenic freezer of claim 1 wherein said cryogenic freezer is rectangular for increasing the storage capacity of the cryogenic freezer.

3. The cryogenic freezer of claim 1 further comprising a means for substantially evacuating air from the vacuum space between the inner container and the outer container.

4. The cryogenic freezer of claim 1 further comprising a molecular sieve for absorbing any gas in the vacuum space.

5. The cryogenic freezer of claim 1, wherein said insulating material is surrounded by at least one piece of reflective foil.

6. A method for assembling a doubled walled vacuum insulated cryogenic freezer for storing materials at temperatures deviating greatly from ambient comprising the steps of:

providing an outer container with four walls and a bottom surface;

positioning at least one layer of insulating material against the inside wall and bottom surface of the outer container for reducing heat transfer;

positioning at least one layer of a geometric grid structure adjacent the insulating material for preventing deflection of the walls and bottom surface when a vacuum is drawn;

positioning an inner container, having four walls and a bottom surface, in the outer container to define a vacuum space therebetween;

connecting the inner container to the outer container at the top walls to seal the vacuum space; and evacuating air from the vacuum space.

7. A cryogenic freezer for storing materials at temperatures deviating greatly from ambient comprising:

a) an inner container, said inner container comprising four walls and a bottom surface;

b) an outer container enclosing the inner container and defining a vacuum space therebetween, said outer container comprising four walls and a bottom surface, said inner container being connected to the outer container at the top of said walls to seal said vacuum space;

c) at least one layer of insulating material in said vacuum space for reducing heat transfer in the freezer;

d) at least one layer of support material positioned in the sealed vacuum space for substantially reducing deflection of the walls when air is evacuated from the vacuum space, wherein said support material is comprised of a three dimensional geometric grid structure; and e) a top for covering the inside of the cryogenic freezer.

8. The cryogenic freezer of claim 7 wherein said support material is open-celled to minimize heat transfer.

* * * * *